US007779892B2

(12) United States Patent
Luczak et al.

(10) Patent No.: US 7,779,892 B2
(45) Date of Patent: Aug. 24, 2010

(54) INVESTMENT CASTING CORES AND METHODS

(75) Inventors: Blake J. Luczak, Manchester, CT (US); Matthew A. Devore, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 244 days.

(21) Appl. No.: 11/801,168

(22) Filed: May 9, 2007

(65) Prior Publication Data

US 2008/0277090 A1 Nov. 13, 2008

(51) Int. Cl.
*B22C 9/10* (2006.01)
*B22C 9/04* (2006.01)
*B22C 7/00* (2006.01)

(52) U.S. Cl. ..... 164/516; 164/28; 164/369; 164/45; 164/235; 164/361

(58) Field of Classification Search ..... 164/516, 164/28, 369, 45, 235, 361, 6
See application file for complete search history.

(56) References Cited

U.S. PATENT DOCUMENTS

| | | | | |
|---|---|---|---|---|
| 6,637,500 | B2 | 10/2003 | Shah et al. | |
| 6,929,054 | B2 | 8/2005 | Beals et al. | |
| 7,014,424 | B2 | 3/2006 | Cunha et al. | |
| 7,134,475 | B2 | 11/2006 | Snyder et al. | |
| 2005/0274478 | A1 * | 12/2005 | Verner et al. | 164/45 |
| 2006/0239819 | A1 | 10/2006 | Albert et al. | |
| 2008/0006384 | A1 | 1/2008 | Memmen | |

OTHER PUBLICATIONS

European Search Report for EP08250733.6, dated Jun. 24, 2008.

* cited by examiner

*Primary Examiner*—Kevin P Kerns
(74) *Attorney, Agent, or Firm*—Bachman & LaPointe, P.C.

(57) ABSTRACT

An investment casting core combination includes a metallic casting core and a ceramic feedcore. A first region of the metallic casting core is embedded in the ceramic feedcore. The metallic casting core includes a plurality of body sections. The first region is along at least some of the body sections. The metallic casting core includes a plurality of springs spanning gaps between adjacent body sections and unitarily formed therewith.

20 Claims, 9 Drawing Sheets

| | | | | | | | | | | | |
|---|---|---|---|---|---|---|---|---|---|---|---|
| L (mm) | 22.9 | 22.9 | 73.7 | 73.7 | 73.7 | 73.7 | 124 | 124 | 124 | 175 | 175 |
| S (mm) | 2.5 | 2.5 | 2.5 | 2.5 | 2.5 | 2.5 | 2.5 | 2.5 | 2.5 | 2.5 | 2.5 |
| Gaps | 1 | 2 | 2 | 3 | 4 | 5 | 3 | 4 | 5 | 4 | 5 |
| Islands | 2 | 3 | 3 | 4 | 5 | 6 | 4 | 5 | 6 | 5 | 6 |
| $L_I$ (mm) | 10.2 | 5.9 | 22.9 | 16.5 | 12.7 | 10.2 | 29.2 | 22.9 | 18.6 | 33.0 | 27.1 |
| $L'_2$-$L'_1$ (mm) | 0.2 | 0.2 | 0.6 | 0.6 | 0.6 | 0.6 | 1.0 | 1.0 | 1.0 | 1.5 | 1.5 |
| S-S' (mm) | 0.2 | 0.1 | 0.3 | 0.2 | 0.2 | 0.1 | 0.3 | 0.3 | 0.2 | 0.4 | 0.3 |
| 100(S-S')/S | 7 | 4 | 12 | 8 | 6 | 5 | 14 | 10 | 8 | 14 | 11 |
| $L_I$/S | 4.0 | 2.3 | 9.0 | 6.5 | 5.0 | 4.0 | 11.5 | 9.0 | 7.3 | 13.0 | 10.7 |
| Gaps/100mm | 4.4 | 8.7 | 2.7 | 4.1 | 5.4 | 6.8 | 2.4 | 3.2 | 4.0 | 2.3 | 2.9 |

FIG. 17

| | | | | | | | | | | | |
|---|---|---|---|---|---|---|---|---|---|---|---|
| L (mm) | 22.9 | 22.9 | 73.7 | 73.7 | 73.7 | 73.7 | 124 | 124 | 124 | 175 | 175 |
| S (mm) | 1.5 | 1.5 | 1.5 | 1.5 | 1.5 | 1.5 | 1.5 | 1.5 | 1.5 | 1.5 | 1.5 |
| Gaps | 1 | 2 | 2 | 3 | 4 | 5 | 3 | 4 | 5 | 4 | 5 |
| Islands | 2 | 3 | 3 | 4 | 5 | 6 | 4 | 5 | 6 | 5 | 6 |
| $L_I$ (mm) | 10.7 | 6.6 | 23.5 | 17.3 | 13.5 | 11.0 | 30.0 | 23.7 | 19.5 | 33.8 | 27.9 |
| $L'_2$-$L'_1$ (mm) | 0.2 | 0.2 | 0.6 | 0.6 | 0.6 | 0.6 | 1.0 | 1.0 | 1.0 | 1.5 | 1.5 |
| S-S' (mm) | 0.2 | 0.1 | 0.3 | 0.2 | 0.2 | 0.1 | 0.3 | 0.3 | 0.2 | 0.4 | 0.3 |
| 100(S-S')/S | 12 | 6 | 20 | 13 | 10 | 8 | 23 | 17 | 14 | 24 | 19 |
| $L_I$/S | 7.0 | 4.3 | 15.4 | 11.3 | 8.9 | 7.2 | 19.7 | 15.5 | 12.8 | 22.2 | 18.3 |
| Gaps/100mm | 4.4 | 8.7 | 2.7 | 4.1 | 5.4 | 6.8 | 2.4 | 3.2 | 4.0 | 2.3 | 2.9 |

FIG. 18

INVESTMENT CASTING CORES AND METHODS

BACKGROUND

The disclosure relates to investment casting. More particularly, it relates to the investment casting of superalloy turbine engine components.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al., U.S. Pat. No. 6,929,054 of Beals et al., U.S. Pat. No. 7,014,424 of Cunha et al., U.S. Pat. No. 7,134,475 of Snyder et al., and U.S. Patent Publication No. 20060239819 of Albert et al. (the disclosures of which are incorporated by reference herein as if set forth at length) disclose use of ceramic and refractory metal core combinations.

SUMMARY

One aspect of the disclosure involves an investment casting core combination. The combination includes a metallic casting core and a ceramic feedcore. A first region of the metallic casting core is embedded in the ceramic feedcore. The metallic casting core includes a plurality of body sections. The first region is along at least some of the body sections. The metallic casting core includes a plurality of springs spanning gaps between adjacent body sections and unitarily formed therewith.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 17 is a table showing effects of thermal expansion on a series of exemplary cores having exemplary U-shaped springs.

FIG. 18 is a table showing effects of thermal expansion on a series of exemplary cores having exemplary S-shaped springs.

Like reference numbers and designations in the various drawings indicate like elements.

DETAILED DESCRIPTION

Figure 1:
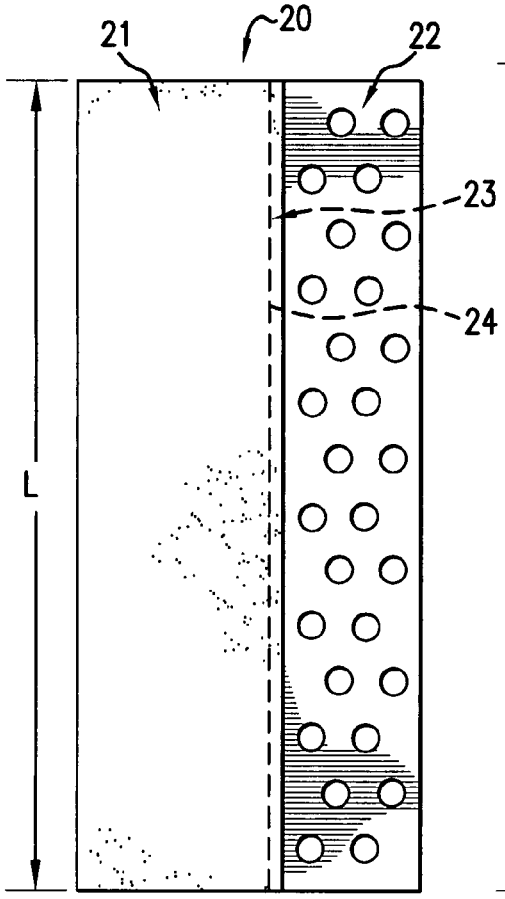
FIG.1 PRIOR ART
FIG. 1 is a partially schematic side view of a prior art core assembly.
Figure 2:
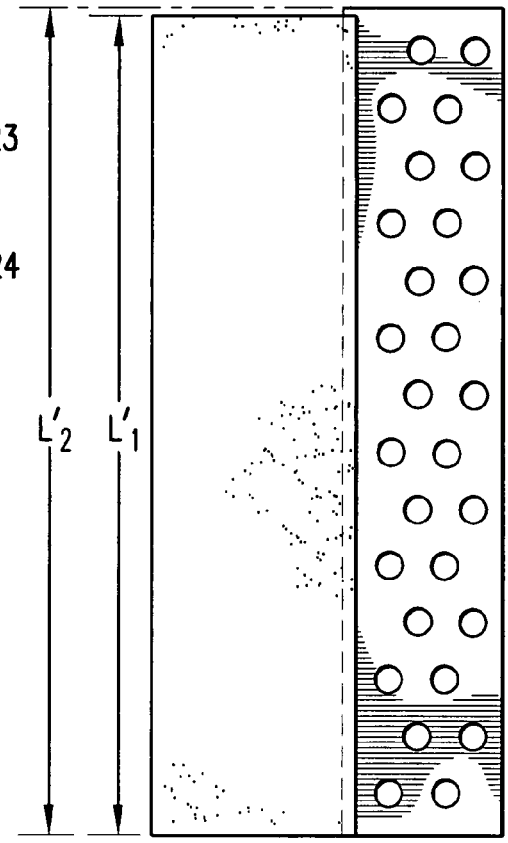
FIG.2 PRIOR ART
FIG. 2 is a view of the core assembly of FIG. 1 at an elevated temperature.

Differential thermal expansion of feedcores and RMCs at one or more stages may present one or more problems. For example, core assembly, shell firing, and casting may present multiple heating/cooling cycles. Differential thermal expansion may contribute to breaking of the cores or their joints. FIG. 1 shows an exemplary core assembly 20 including a ceramic feedcore 21 and an RMC 22. The exemplary assembly is illustrative of a feedcore forming a trailing edge slot for a blade or vane airfoil. A joint 23 is formed by a leading region of the exemplary RMC 22 mounted in a trailing slot 24 in the feedcore 21. An exemplary RMC 22 has a higher CTE than a CTE of the feedcore 21. FIG. 2 shows the effect of differential thermal expansion upon heating of the feedcore 21 and RMC 22 above the temperature of their FIG. 1 condition. At the FIG. 1 temperature, the joint 23 has a length L. At the FIG. 2 temperature, the RMC has experienced a span-wise relative lengthening which may have contributed to a loosening of the joint or a damaging of the feedcore. The portion of the ceramic feedcore 21 previously along the joint has expanded to a length $L'_1$. The corresponding portion of the RMC 22 has, however, expanded by a greater amount to a length $L'_2$.

Figure 3:
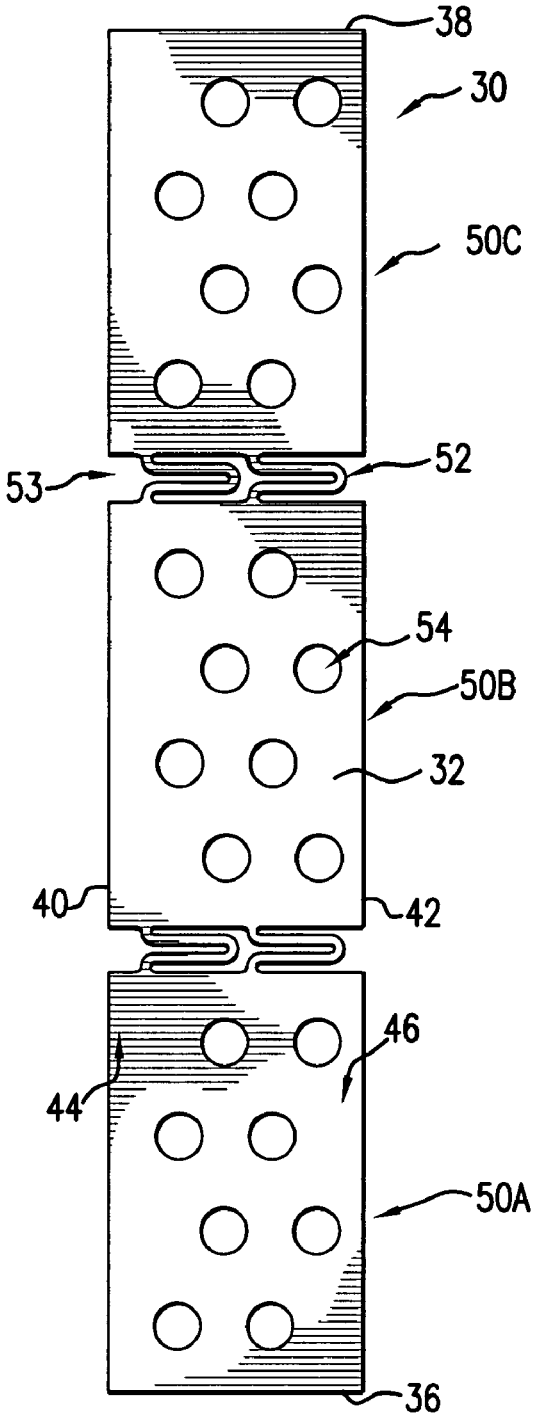
FIG. 3 is a partially schematic side view of a revised refractory metal core.
Figure 4:
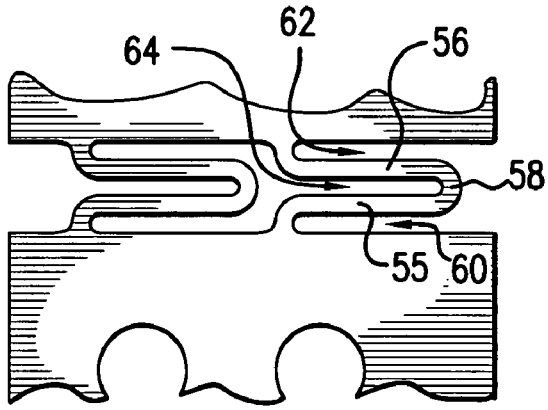
FIG. 4 is an enlarged view of the core of FIG. 3.
Figure 5:
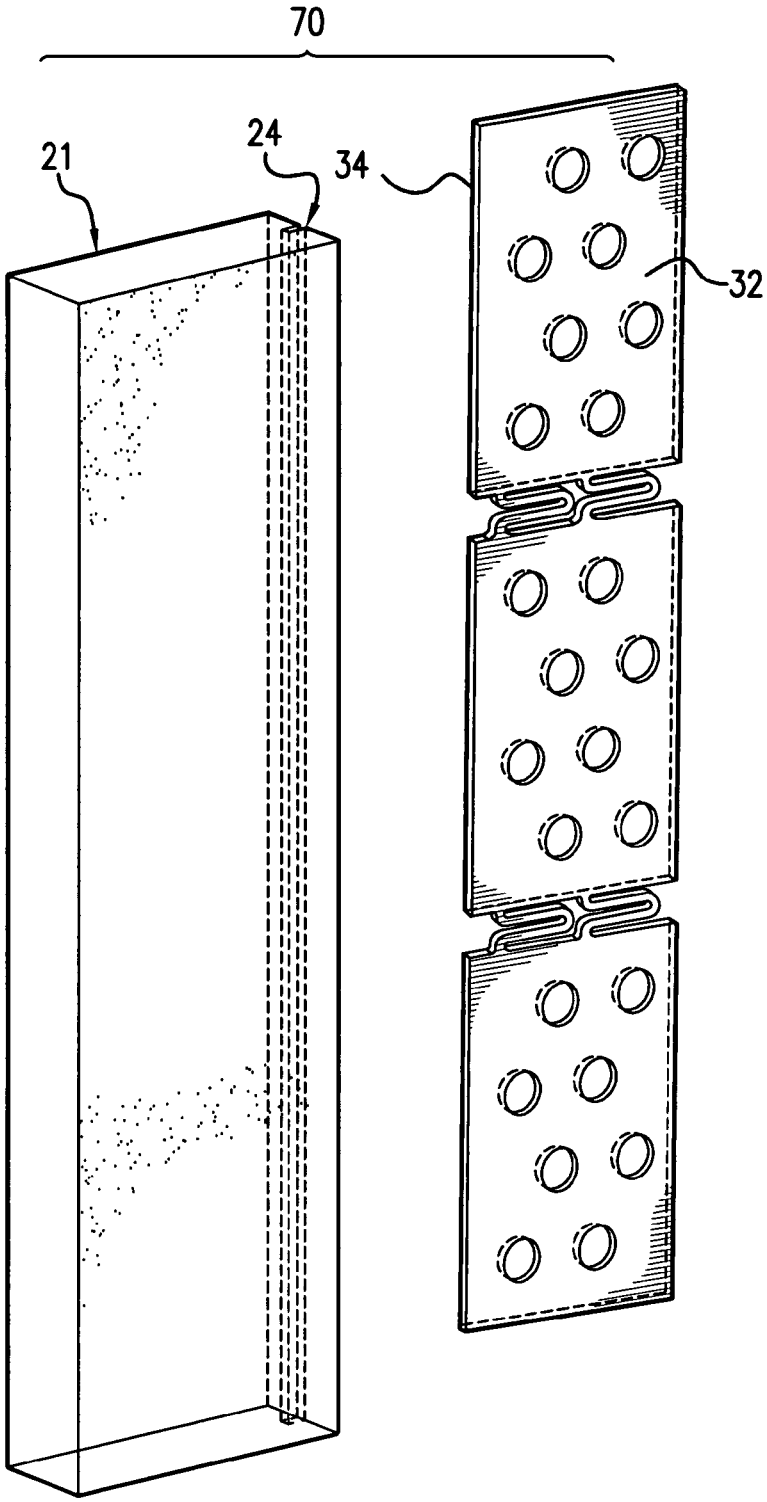
FIG. 5 is an exploded view of a revised core assembly including the core of FIG. 3.
Figure 6:
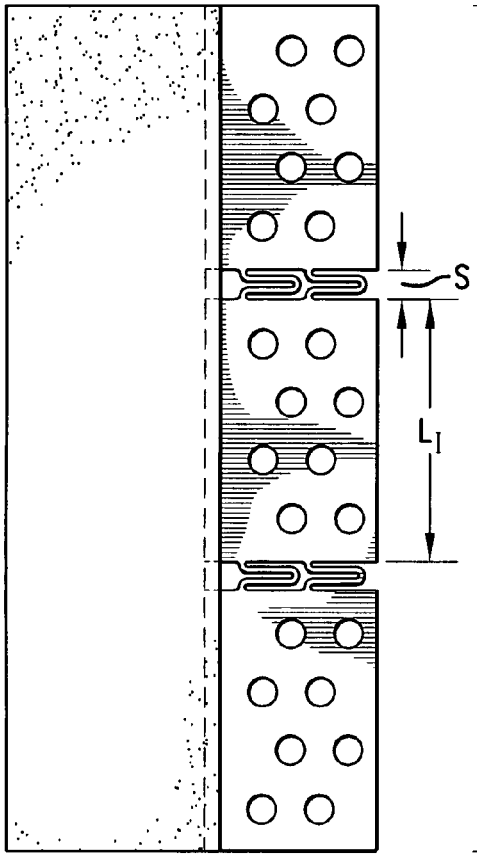
FIG. 6 is a partially schematic side view of the core assembly of FIG. 5.
Figure 7:
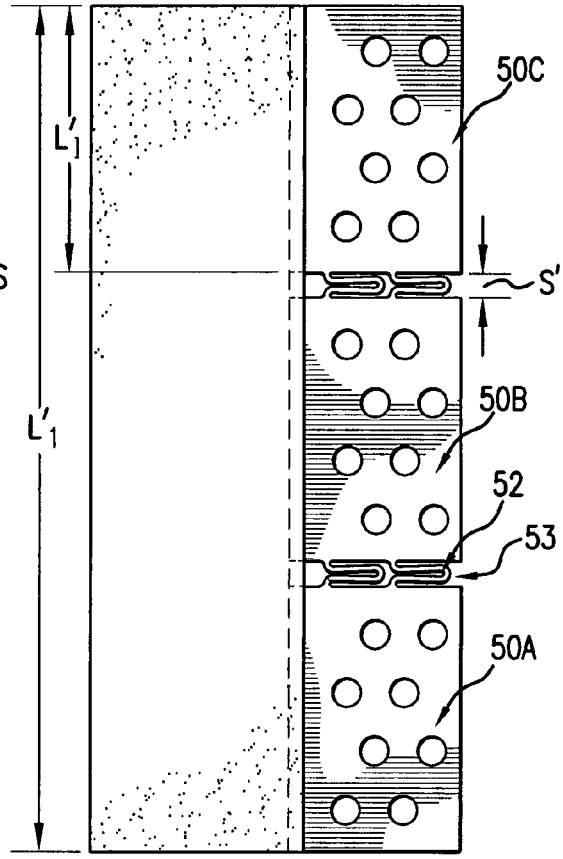
FIG. 7 is a view of the core assembly of FIG. 6 at an elevated temperature.

To address differential thermal expansion, a modified feedcore 30 is shown in FIGS. 3 and 4. The modified feedcore 30 may similarly be formed from sheetstock and have first and second faces 32 and 34 (FIG. 5). For forming an exemplary trailing edge discharge slot, the exemplary feedcore 30 has first and second span-wise ends/edges (e.g., an inboard end 36 and an outboard end 38) and first and second streamwise ends/edges (e.g., a leading edge 40 and a trailing edge 42).

As with the exemplary baseline core, a region 44 of the RMC (e.g., a portion near the leading end/edge 40) may be received by the feedcore (e.g., the slot 24). A region 46 (e.g., near the trailing end/edge 42) may be received in the pattern forming die and, ultimately, in the shell so as to cast one or more openings in the surface of the casting.

To provide means for compensating for differential CTE, the RMC includes a plurality of islands 50A-50C joined to each other by integrally formed springs 52 spanning gaps 53 between the islands. The exemplary springs are unitarily formed with the islands by removing adjacent material from the refractory metal sheetstock. The removal may be part of the same process that forms additional holes/apertures 54 in the islands (e.g., for casting posts in the ultimate discharge slot). The exemplary apertures 54 are internal through-apertures. They are "internal" or "closed" in that they are not open to the lateral perimeters of the islands (e.g., along the leading and trailing edges, the inboard and outboard edges, or along the gaps).

Each of the exemplary islands includes a portion of the region 44 that mates with the feedcore and the region 46 that mates with the shell. These portions may be chosen to be short enough (in span-wise dimension) so that the total strain along each portion associated with differential thermal expansion is not sufficient to cause an unwanted level of damage. The springs compensate for the total strain difference by locally flexing (e.g., so that the net change in RMC span-wise length at the joint 23 is less than it would be with the baseline RMC 22).

The exemplary springs 52 are approximately U-shaped with first and second legs 55 and 56 joining at a terminal end or trough 58. The legs 55 and 56 are respectively adjacent first and second ones of the islands and spaced apart from the islands by lateral gaps 60 and 62 and from each other by a central gap 64.

Similar to FIGS. 1 and 2, FIGS. 6 and 7 respectively show the modified core assembly 70 of FIG. 5 at two different temperatures. From FIG. 1 to FIG. 2 and FIG. 6 to FIG. 7, there is relatively greater thermal expansion of the material of the RMC 30 than the feedcore 21. Each of the islands 50A-50C may expand (e.g., from a spanwise length $L_I$ to $L'_I$) in similar fashion to the expansion of the baseline RMC 22. However, the gaps 53 have contracted (e.g., from a spanwise separation/width S to S'), flexing/compressing the springs 52 to accommodate the differential expansion. The accommodation may allow an overall expansion of the RMC along the joint to be essentially the same as the expansion of the feedcore.

For core stability, multiple springs 52 may be present at each gap. An exemplary number of springs is 2-4 at each gap. An exemplary contraction of the gap is at least 3%, more narrowly at least 8% between room temperature (e.g., 20° C.) and a pre-heat temperature prior to receiving the casting alloy (e.g., 1500° C.). In the exemplary trailing edge RMC, an exemplary number of islands is 3-6. Exemplary island lengths $L_I$ are 5-30 times the separations S, more narrowly 5-20. Exemplary island lengths are about 0.4-1.5 inch (10-38 mm).

Figure 8:
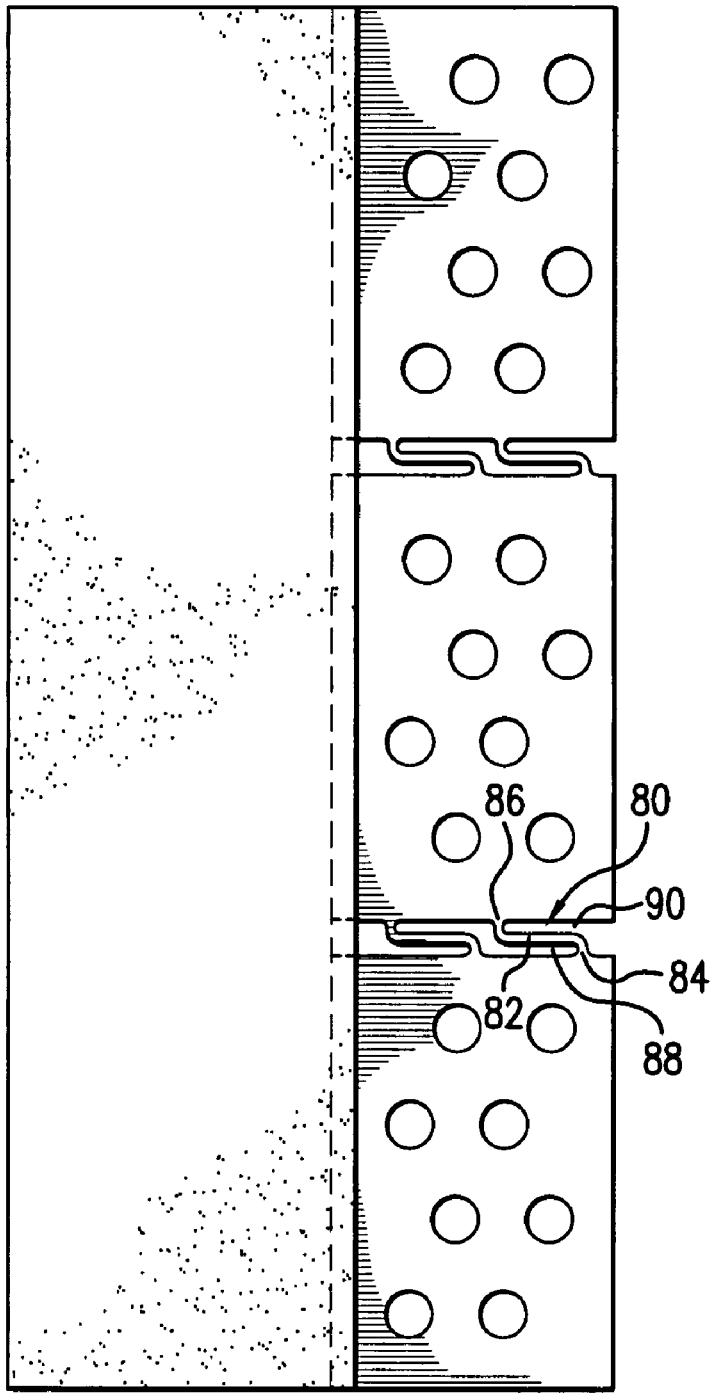
FIG. 8 is a partially schematic side view of a core assembly including a second revised RMC.

Alternative springs 80 (FIG. 8) may be more S-shaped. The exemplary springs 80 each have a central slotwise/streamwise leg 82 with first and second slotwise/streamwise spaced-apart junctions 84 and 86 with the two adjacent islands. Gaps 88 and 90 separate the central portion of the leg from the adjacent islands.

Figures 9, 10, 11, 12:
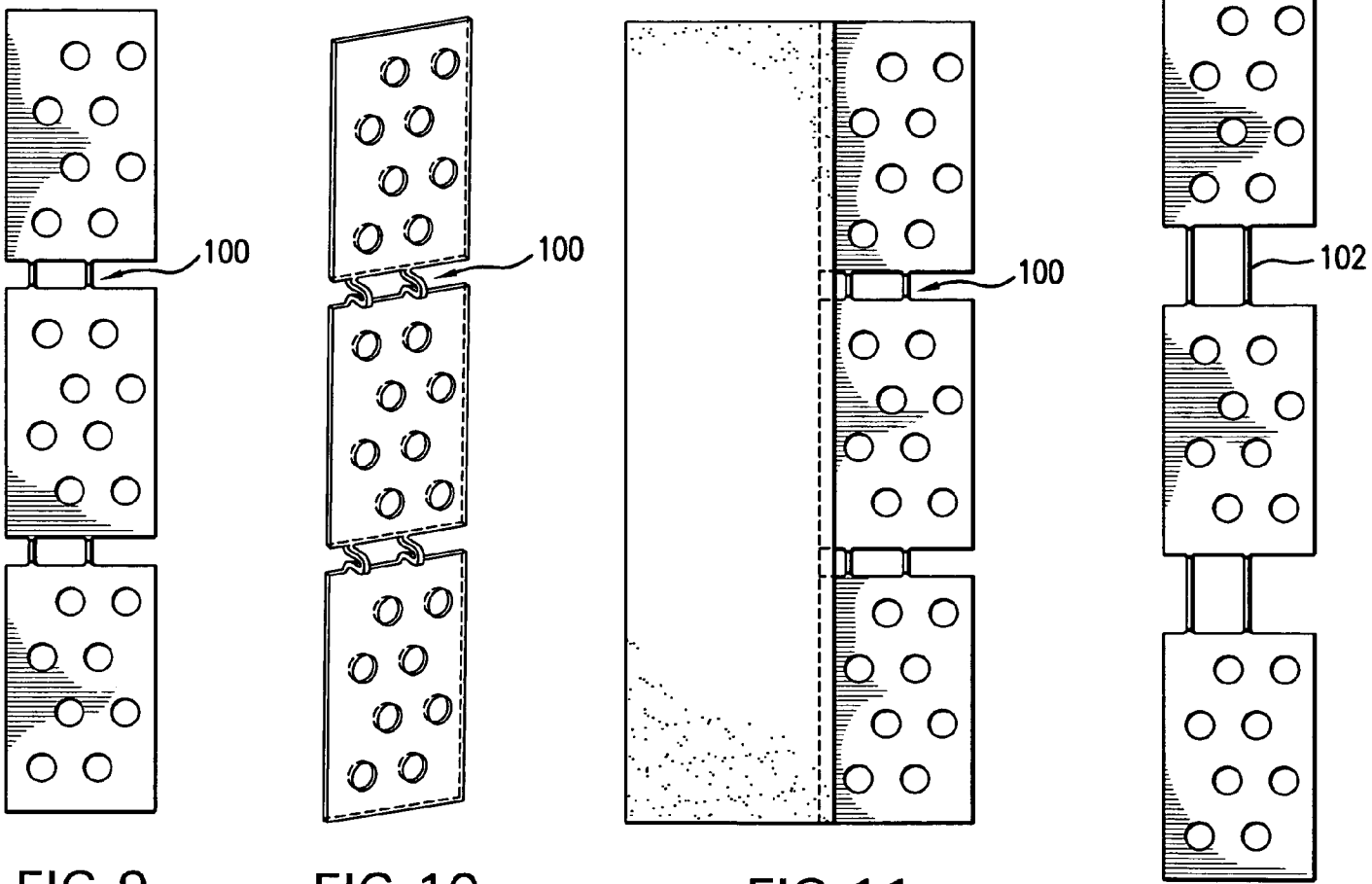
FIG. 9 is a partially schematic side view of a third revised RMC.
FIG. 10 is a view of the RMC of FIG. 9.
FIG. 11 is a partially schematic side view of a core assembly including the RMC of FIG. 9.
FIG. 12 is a side view of a precursor to the RMC of FIG. 9.

Other alternatives involve springs which depart from the local plane(s) and faces of the islands. For example, FIGS. 9-11 show U-shaped springs 100 extending essentially normal to the local plane(s) of the islands. Whereas the springs 52 and 80 may be formed by cutting from sheetstock without deformation, the out-of-plane springs 100 may be formed by deformation of in-plane spring precursors. For example, FIG. 12 shows spring precursors 102 as relatively straight legs between the islands. The exemplary legs are relatively straight and extend relatively normal to the inter-island gaps. The precursors 102 may be pushed out of the plane (FIGS. 9 and 10) to form the springs, during this process the islands are drawn together to partially close the inter-island gaps. The deformation may be inelastic so that FIGS. 9 and 10 represent relaxed (i.e., not under external load) conditions.

Such out-of-plane springs may be configured to cast desired outlets. For example, the springs may be dimensioned so that their terminals/troughs fall outside the molded pattern wax and become embedded in the shell to ultimately cast outlet passageways and openings from the slot to the adjacent surface of the casting. Such passageways may be used for film cooling of the surface of the part.

Figure 13:
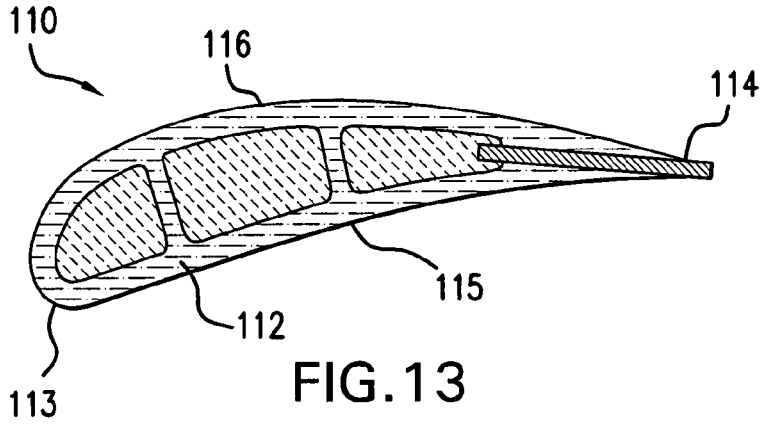
FIG. 13 is a sectional view of an investment casting pattern.

FIG. 13 shows a pattern 110 formed by the molding of wax over the core assembly. The wax includes an airfoil portion 112 extending between a leading edge 113 and a trailing edge 114 and having a pressure side 115 and a suction side 116. The pattern may further include portions for forming an outboard shroud and/or an inboard platform (not shown).

Figure 14:
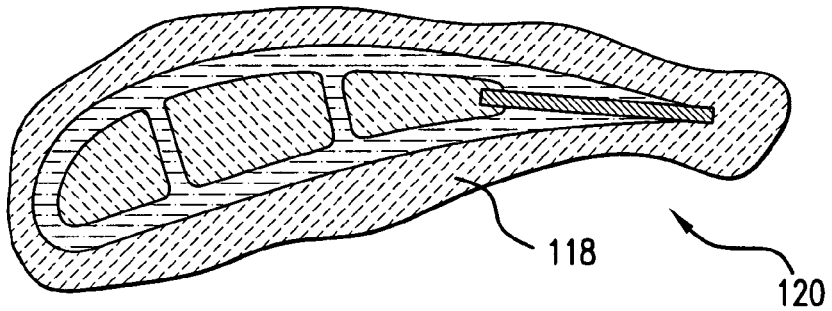
FIG. 14 is a sectional view of a shell formed over the pattern of FIG. 13.

FIG. 14 is a sectional view showing the pattern airfoil after shelling with stucco 118 to form the shell 120.

Figure 15:
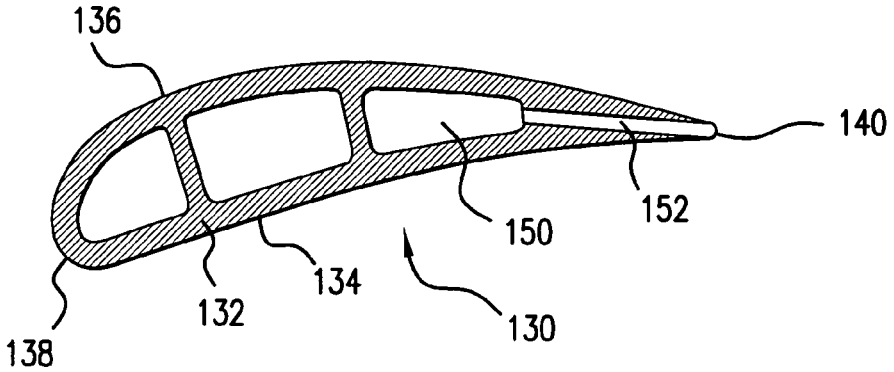
FIG. 15 is a sectional view of a casting cast by the shell of FIG. 14.

FIG. 15 shows the resulting casting 130 after deshelling and decoring. The casting has an airfoil 132 having a pressure side 134 and a suction side 136 and extending from a leading edge 138 to a trailing edge 140. The ceramic feedcore 21 casts one or more feed passageways 150 and the RMC casts a discharge outlet slot 152.

Figure 16:
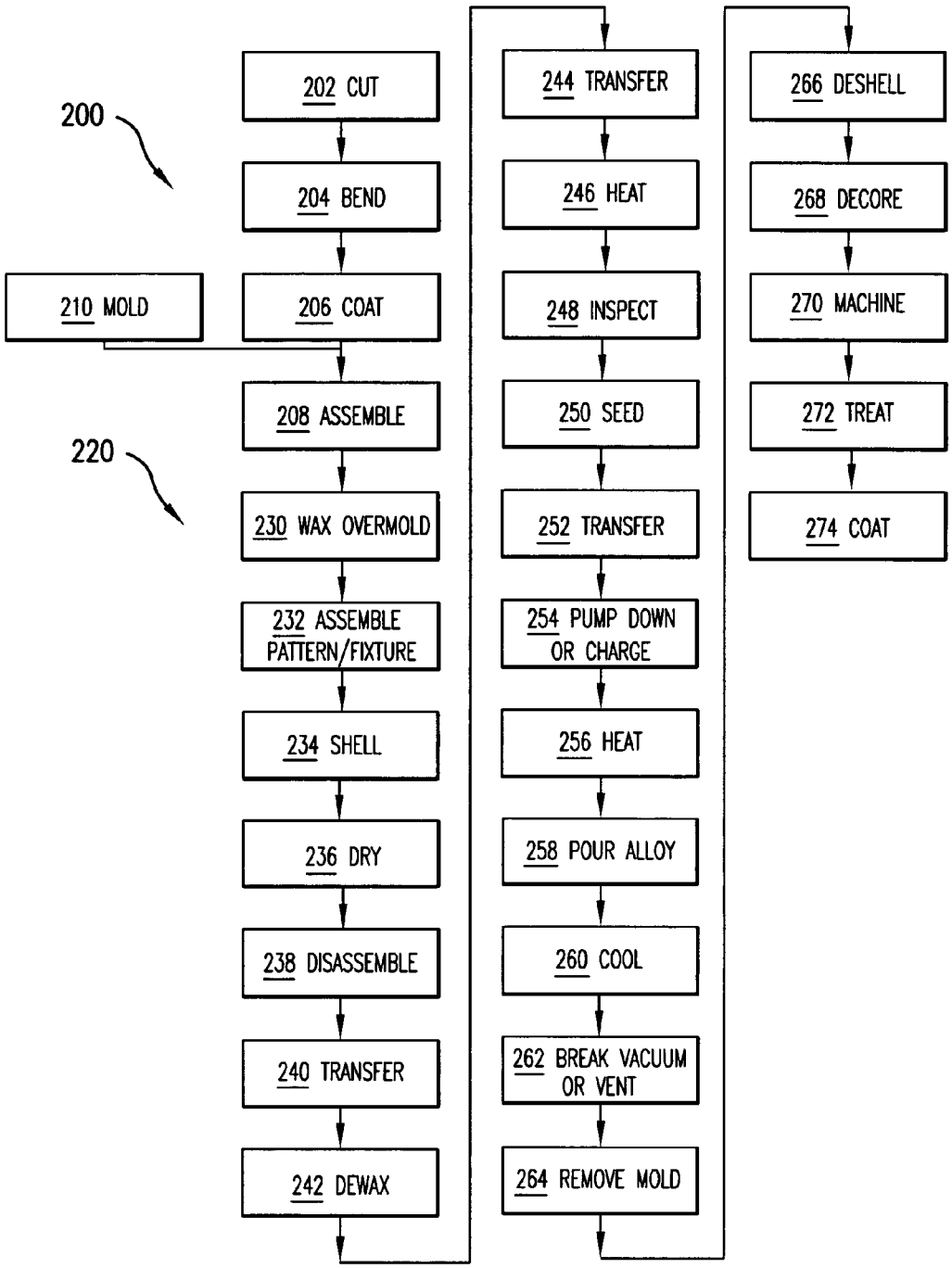
FIG. 16 is a flowchart of a core manufacturing process.

Steps in the manufacture 200 of the core assembly are broadly identified in the flowchart of FIG. 16. In a cutting operation 202 (e.g., laser cutting, electro-discharge machining (EDM), liquid jet machining, or stamping), a cutting is cut from a blank. The exemplary blank is of a refractory metal-based sheet stock (e.g., molybdenum or niobium) having a thickness in the vicinity of 0.01-0.10 inch (0.2-2.5 mm) between parallel first and second faces and transverse dimensions much greater than that. The exemplary cutting has the cut features of the RMC including the springs 52, 80, 100, or their precursors (e.g., 102), and the holes 54.

In a second step 204, if appropriate, the cutting is bent at the spring precursors (e.g., 102) to provide their shapes. More complex forming procedures are also possible.

The RMC may be coated 206 with a protective coating. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

The RMC may then be mated/assembled 208 to the feedcore. For example, the feedcore may be pre-molded 210 and, optionally, pre-fired. The slot or other mating feature may be formed during that molding or subsequent cut. The RMC leading region may be inserted into the feedcore slot. Optionally, a ceramic adhesive or other securing means may be used. An exemplary ceramic adhesive is a colloid which may be dried by a microwave process. Alternatively, the feedcore may be overmolded to the RMC. For example, the RMC may be placed in a die and the feedcore (e.g., silica-, zircon-, or alumina-based) molded thereover. An exemplary overmolding is a freeze casting process. Although a conventional molding of a green ceramic followed by a de-bind/fire process may be used, the freeze casting process may have advantages regarding limiting degradation of the RMC and limiting ceramic core shrinkage.

FIG. 16 also shows an exemplary method 220 for investment casting using the composite core assembly. Other methods are possible, including a variety of prior art methods and yet-developed methods. The core assembly is then overmolded 230 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 232 to a shelling fixture (e.g., via wax welding between end plates of the fixture). The pattern may then be shelled 234 (e.g., via one or more stages of slurry dipping, slurry spraying, or the like). After the shell is built up, it may be dried 236. The drying provides the shell with at least sufficient strength or other physical integrity properties to permit subsequent processing. For example, the shell containing the invested core assembly may be disassembled 238 fully or partially from the shelling fixture and then transferred 240 to a dewaxer (e.g., a steam autoclave). In the dewaxer, a steam dewax process 242 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 244 to a furnace (e.g., containing air or other oxidizing atmosphere) in which it is heated 246 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 248. The mold may be seeded 250 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 252 to a casting furnace (e.g., placed atop a chill plate in the furnace). The casting furnace may be pumped down to vacuum 254 or charged with a non-oxidizing atmosphere (e.g., inert gas) to prevent oxidation of the casting alloy. The casting furnace is heated 256 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 258 into the mold and the mold is allowed to cool to solidify 260 the alloy (e.g., after withdrawal from the furnace hot zone). After solidification, the vacuum may be broken 262 and the chilled mold removed 264 from the casting furnace. The shell may be removed in a deshelling process 266 (e.g., mechanical breaking of the shell).

The core assembly is removed in a decoring process 268 to leave a cast article (e.g., a metallic precursor of the ultimate part). The cast article may be machined 270, chemically and/or thermally treated 272 and coated 274 to form the ultimate part. Some or all of any machining or chemical or thermal treatment may be performed before the decoring.

FIGS. 17 and 18 respectively show calculated effects of differential thermal expansion on RMCs having U-shaped springs (e.g., 52) and S-shaped (e.g., 80). The tables reflect conversion from English units and rounding. The RMCs are mounted in ceramic feedcores and locked thereto at longitudinal ends of the RMCs (e.g., by ends of the mating slot in the feedcore). Thermal expansion is simulated from a reference of 20° C. to 1500° C. (e.g., slightly above a melting temperature of several Ni alloys). The coefficients of thermal expansion are ~$10^{-6}$/° C. for the feedcore and ~$6.6\times10^{-6}$/° C. for the RMC. At these temperatures, an exemplary decrease in S is at least 3% (e.g., 3-30%), more narrowly, 4-25%, or 6-15%, depending upon selected spring geometry. For example, an S-shaped spring may permit more compression than a U-shaped spring. Thus, an exemplary narrower range particular to an S-shaped spring would be 9-25% roughly corresponding to a 5-15% range for the U-shaped spring.

One or more embodiments have been described. Nevertheless, it will be understood that various modifications may be made. For example, the principles may be implemented using modifications of various existing or yet-developed processes, apparatus, or resulting cast article structures (e.g., in a reengineering of a baseline cast article to modify cooling passageway configuration). In any such implementation, details of the baseline process, apparatus, or article may influence details of the particular implementation. Accordingly, other embodiments are within the scope of the following claims.

What is claimed is:

1. An investment casting core combination comprising:

a metallic casting core; and a ceramic feedcore in which a first region of the metallic casting core is embedded, wherein the metallic casting core comprises:

a plurality of body sections, the first region being along at least some of the body sections; and a plurality of springs, spanning gaps between adjacent said body sections and unitarily formed therewith.

2. The investment casting core combination of claim 1 wherein:

a plurality of springs comprises a plurality of U-shaped springs unitarily formed with the plurality of body sections.

3. The investment casting core combination of claim 2 wherein:

the springs protrude out of coplanar with the adjacent said body sections.

4. The investment casting core combination of claim 1 wherein:

a plurality of springs comprises a plurality of S-shaped springs unitarily formed with the plurality of body sections.

5. The investment casting core combination of claim 1 wherein:

the springs protrude out of coplanar with the adjacent said body sections.

6. The investment casting core combination of claim 1 wherein:

the body sections each comprise a plurality of internal apertures.

7. The investment casting core combination of claim 1 wherein:

the body sections each have parallel first and second faces.

8. An investment casting pattern comprising:

the investment casting core combination of claim 1; and a wax material at least partially encapsulating the metallic casting core and the feedcore and having:

an airfoil contour surface including:

a leading edge portion;

a trailing edge portion; and pressure and suction side portions extending from the leading edge portion to the trailing edge portion, the metallic casting core protruding from the wax material proximate the trailing edge portion.

9. An investment casting shell comprising:

the investment casting core combination of claim 1; and a ceramic stucco at least partially encapsulating the metallic casting core and the feedcore; and an airfoil contour interior surface including:

a leading edge portion;

a trailing edge portion; and pressure and suction side portions extending from the leading edge portion and formed by the ceramic stucco, the metallic casting core protruding into the stucco proximate the trailing edge portion.

10. A method for forming the core of claim 1 comprising:

forming a metallic core precursor from sheetstock, the precursor including the body sections and precursors of the springs;

deforming the spring precursors to form the springs; and assembling the metallic core to the ceramic feedcore.

11. The method of claim 10 wherein:

the assembling comprises mounting an edge portion of the refractory metal core in a slot of the ceramic feedcore.

12. The method of claim 10 wherein the forming of the precursor includes:

at least one of laser cutting, electro-discharge machining, liquid jet cutting, and stamping.

13. The method of claim 10 wherein the forming of the precursor includes:

cutting a plurality of closed through apertures in each of the body sections.

14. The method of claim 10 further comprising:

coating the refractory metal core.

15. The method of claim 10 further comprising:

molding a pattern-forming material at least partially over the core assembly for forming a pattern;

shelling the pattern;

removing the pattern-forming material from the shelled pattern for forming a shell;

introducing molten alloy to the shell; and removing the shell and core assembly.

16. The method of claim 15 used to form a gas turbine engine component.

17. An investment casting core assembly comprising:

a ceramic core; and a metallic core, the metallic core comprising:

first means for casting a plurality of segments of an outlet slot; and second means for joining the first means and accommodating differential thermal expansion of the metallic core relative to the ceramic core.

18. The assembly of claim 17 wherein:

the second means comprises a plurality of U-shaped springs unitarily formed with the first means.

19. The assembly of claim 18 wherein:

the springs protrude out of coplanar with the first means.

20. The assembly of claim 17 wherein:

the second means comprises a plurality of S-shaped springs unitarily formed with the first means.

* * * * *